US010273121B2

(12) United States Patent
Griese et al.

(10) Patent No.: US 10,273,121 B2
(45) Date of Patent: Apr. 30, 2019

(54) GAS TURBINE HAVING A LIFTING MECHANISM

(71) Applicant: Siemens Aktiengesellschaft, Munich (DE)

(72) Inventors: Andreas Griese, Berlin (DE); Dirk Müller, Mülheim a.d.Ruhr (DE); Katrin Tritsch, Berlin (DE); Heiko Gellenthien, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 15/524,347

(22) PCT Filed: Nov. 5, 2015

(86) PCT No.: PCT/EP2015/075817
§ 371 (c)(1),
(2) Date: May 4, 2017

(87) PCT Pub. No.: WO2016/078926
PCT Pub. Date: May 26, 2016

(65) Prior Publication Data

US 2017/0313556 A1 Nov. 2, 2017

(30) Foreign Application Priority Data

Nov. 18, 2014 (EP) ..... 14193683

(51) Int. Cl.
*B66C 23/18* (2006.01)
*F01D 25/28* (2006.01)
*B66C 23/02* (2006.01)

(52) U.S. Cl.
CPC ..... *B66C 23/18* (2013.01); *B66C 23/025* (2013.01); *B66C 23/027* (2013.01);
(Continued)

(58) Field of Classification Search
CPC ..... B66C 23/025; B66C 23/027; B66C 23/18; F01D 25/285; F05D 2220/32; F05D 2230/80
See application file for complete search history.

(56) References Cited

U.S. PATENT DOCUMENTS 5,383,652 A 1/1995 Van Den Berg
2001/0025406 A1 10/2001 Scott et al.
(Continued)

FOREIGN PATENT DOCUMENTS

EP 2543868 A2 1/2013
KR 20160022806 A 3/2016

OTHER PUBLICATIONS

EP Search Report dated May 11, 2015, for EP patent application No. 14193683.1.
(Continued)

*Primary Examiner* — Michael R Mansen
*Assistant Examiner* — Juan J Campos, Jr.
(74) *Attorney, Agent, or Firm* — Beusse Wolter Sanks & Maire

(57) ABSTRACT

A crane system having a gas turbine that has a manhole on the outer housing thereof, the manhole being designed to open up a maintenance access to hot gas parts of the gas turbine in the open state of the manhole, which is provided with a fastening section; the crane system further has a hoisting mechanism that includes a mating fastening section which is connected to the fastening section of the manhole in such a way that the hoisting mechanism introduces weights that same has to lift into the outer housing of the gas turbine.

11 Claims, 3 Drawing Sheets

(52) U.S. Cl.
CPC ..... *F01D 25/285* (2013.01); *F05D 2220/32* (2013.01); *F05D 2230/80* (2013.01)

(56) References Cited

U.S. PATENT DOCUMENTS

| | | | | |
|---|---|---|---|---|
| 2007/0273154 | A1* | 11/2007 | Pedersen | B66C 23/027 290/44 |
| 2011/0200435 | A1* | 8/2011 | Pedersen | F03D 1/003 416/146 R |
| 2013/0011241 | A1* | 1/2013 | Skaustein | F01D 25/285 415/123 |
| 2013/0309090 | A1* | 11/2013 | Abolfazlian | F03D 1/003 416/1 |
| 2015/0071790 | A1* | 3/2015 | Tieke | B66C 23/207 416/244 A |
| 2015/0086367 | A1* | 3/2015 | Holloway | F03D 1/003 416/146 R |
| 2016/0052754 | A1 | 2/2016 | Winter et al. | |

OTHER PUBLICATIONS

International Search Report dated Feb. 10, 2016, for PCT/EP2015/075817.
KR Notice of Allowance dated Sep. 29, 2017, for KR patent application No. 10-2017-7011841.

* cited by examiner

GAS TURBINE HAVING A LIFTING MECHANISM

CROSS REFERENCE TO RELATED APPLICATIONS

This application is the US National Stage of International Application No. PCT/EP2015/075817 filed Nov. 5, 2015, and claims the benefit thereof. The International Application claims the benefit of European Application No. EP14193683 filed Nov. 18, 2014. All of the applications are incorporated by reference herein in their entirety.

FIELD OF INVENTION

The present invention relates to a crane system for a gas turbine and to a lifting mechanism which can be used within the scope of such a crane system, and to a method for producing such a crane system.

BACKGROUND OF INVENTION

During maintenance work on a gas turbine, it is sometimes necessary to support or lift heavy loads. For example, when replacing a burner, the latter usually has to be removed as a unit out of or from the gas turbine. The loads to be lifted or supported in this case are of such a size that a specialized lifting device has to be used. In addition, numerous gas turbines are designed in such a manner that the maintenance access to certain regions of the components which, during operation of the gas turbine, are acted upon by hot gas has to be realized via those openings which are normally closed off by the burners. In order to perform, for example, replacement work on these components acted upon by hot gas, the burners therefore firstly need to be removed from the gas turbine, so that the maintenance work can be carried out via the burner openings.

A suitable lifting device for maintenance work on a gas turbine is known for example from EP 2 543 868 A2, which device can be fitted to the housing of the compressor.

Alternatively, with some gas turbines it is also possible to make the region acted upon by hot gas in the interior of a gas turbine accessible to the maintenance personnel via a specifically designed maintenance access point, referred to as a manhole. This access is not adequate for all maintenance work, however, and for this reason in many cases cannot replace the removal of other components on the outer housing of the gas turbine in order to make the interior regions accessible.

In order to be able to handle the loads to be lifted or supported during the maintenance work, lifting cranes which can be moved in a suitable manner, for example via a load rail system in the ceiling region of a power plant hall, are typically used. Here, the loads to be supported or lifted by the lifting crane are accommodated in a suitable manner, for example by a cable system that interacts with the lifting crane. The counterforces to be applied for supporting or lifting are suitably diverted by the lifting crane into predefined supports of the power plant hall via the ceiling structure. As an alternative to such ceiling cranes, mobile crane systems can also be used, which firstly have to be brought close to the gas turbine to be maintained, in order subsequently to be able to advantageously provide a crane boom for the maintenance work. Here, the forces necessary for the lifting or supporting of the loads are diverted into the foundation around the gas turbine via the crane boom.

A disadvantage of these mechanisms known from the prior art is that the lifting mechanisms to be provided are of a very complex design. In the case of a ceiling crane, it is, for example, necessary to install a complicated load rail system in the ceiling region, said system being equipped with suitable supports. In the case of mobile cranes, for the purpose of providing mobility, a movement unit which makes it possible to move the lifting device into a suitable maintenance position needs to be provided. Usually, these are movement units equipped with rollers or wheels, which in addition also require a relatively large amount of space and for this reason significantly limit the space that can be made available to the maintenance personnel.

On account of the high costs for such lifting devices, it is also usually not possible for economic reasons to provide more than one lifting device. This again hinders the procedure of the maintenance work, since, for example, it is only possible for a crane used to be available for one lifting or supporting operation, during which period, however, a second lifting or supporting device would possibly be necessary. Furthermore, within the scope of the maintenance work, it is usually essential to leave the lifted or supported loads on the lifting device, since improper setting down of the object in question would only lead to very expensive follow-up measures. In this respect, these objects are often left on the lifting device during the maintenance work, until the object in question can be fitted onto or into the gas turbine again following completion of the maintenance work.

These disadvantages give rise to the technical requirement of proposing a lifting mechanism, or a crane system comprising such a lifting mechanism, which can avoid these disadvantages. In particular, it is desirable for the lifting mechanism to be proposed or the crane system to be able to be provided in a cost-effective and space-saving manner, on the one hand, but, on the other hand, also to be suitable for supporting the loads to be lifted or supported during maintenance work on a gas turbine according to requirement. In particular, the lifting mechanism or the crane system should make it possible to perform maintenance work on the outer housing of the gas turbine in a largely flexible manner and without severe limitations concerning the space available for the maintenance.

SUMMARY OF INVENTION

These objects are achieved by a crane system as claimed and a lifting mechanism as claimed and also of a method for producing such a crane system as claimed.

In particular, objects upon which the invention is based are achieved by a crane system comprising a gas turbine which has a manhole on its outer housing, said manhole being designed to open up a maintenance access point to hot gas parts when opened, wherein the manhole has a fastening section, and furthermore comprising a lifting mechanism which has a mating fastening section that is connected to the fastening section in such a way that the lifting mechanism introduces weight forces to be lifted by said mechanism into the outer housing of the gas turbine.

The objects upon which the invention is based are further achieved by a lifting mechanism, which is designed in particular to be used in a crane system corresponding to the description given above and below, said lifting mechanism having a mating fastening section which is designed to be connected to a fastening section of a manhole of a gas turbine in such a manner that the lifting mechanism can introduce weight forces to be lifted by said mechanism into the fastening section via the mating fastening section.

The objects upon which the invention is based are further achieved by a method for producing a crane system, in particular a crane system as described above and below, comprising the following steps:—opening a manhole on the outer housing of a gas turbine;—fastening a mating fastening section of a lifting mechanism to a fastening section of the manhole.

As already described above, the maintenance access referred to as a manhole is designed in particular in such a manner that a person from the maintenance personnel can pass through the opening into the interior of the gas turbine. This degree of accessibility is sometimes necessary in order to be able to suitably maintain or replace components which, during operation of the gas turbine, are acted upon by hot gas. The fastening section of the manhole normally serves for fastening a suitable closure element, such as a cover. The closure element in turn, when used according to its intended use, allows the manhole to be closed in such a manner that, for the gas turbine, there is no risk of any or any significant hot gas losses in the region of the manhole during regular operation. In other words, the fastening section of the manhole is primarily designed to provide a suitable connection region for the closure element. This section is typically designed as a round flange. This flange can then be screwed to the closure element for example by means of suitable screws and thus also have sufficient tightness in order to safely enclose even hot gases during regular operation of the gas turbine.

According to the invention, it is now proposed to provide this fastening section of the manhole for a connection to a suitable mating fastening section of the lifting mechanism. In other words, when carrying out the maintenance work, the fastening section of the manhole would firstly be uncovered, for example by removing the closure element, and subsequently this fastening section would be connected to a suitable mating fastening section of the lifting mechanism. On account of the connection of the mating fastening section and the fastening section, the weight forces to be lifted or supported by the lifting mechanism are now diverted into the outer housing of the gas turbine via the sections in question. A direct support, for example with respect to the foundation upon which the gas turbine stands, can thus be dispensed with. Similarly, the provision of, for example, a ceiling crane, arranged in the region of the ceiling section of the building in which the gas turbine is located, can be dispensed with.

The mating fastening section, and also the fastening section, is advantageously designed as a round flange. It can be screwed to the fastening section, for example by means of suitable screws. The flange has a thickened region via which the forces can be further directed and also, at the same time, the lifting mechanism acquires sufficient stability in the installed state.

Not only does this advantageously result in a gain in space, in particular in comparison to mobile lifting devices which have to be positioned next to the gas turbine, but also the positioning of the crane system or the lifting mechanism at or on the gas turbine is already advantageously achieved. According to the invention, it is therefore not necessary to suitably place an external lifting device prior to carrying out the maintenance work, in order to subsequently perform the maintenance work with this lifting device. According to the invention, advantageous positioning is already catered for with the fitting of the lifting mechanism on the gas turbine via the fastening section, and so maintenance work can be carried out in all or numerous sections of the outer housing of the gas turbine.

Furthermore, the supporting of the loads to be lifted or supported advantageously takes place via the outer housing of the gas turbine and caters for an introduction of force into the foundation upon which the gas turbine is already positioned. This foundation is typically designed for loading with large weight forces, and so, here too, there is no need for concern that, for example, changes in the structure of the foundation would result. Moreover, because of the connection of the gas turbine and the lifting mechanism, a movement unit, for example, which is necessary in the case of mobile cranes, is not required. In this respect, the crane according to the invention can also be provided at a relatively low cost.

At this juncture, it should be pointed out that a lifting mechanism within the meaning of the invention should serve both for lifting loads and for lowering loads, but can additionally be provided also, or possible only, for the horizontal translation of loads.

It should furthermore be pointed out that the dimensions of the lifting mechanism are typically such that all maintenance-relevant regions at the gas turbine can be reached. This relates in particular to the region in which the burners are arranged at the gas turbine. It should furthermore be pointed out that, although the manhole providing the maintenance access can be provided in an open state for numerous maintenance operations, this is not necessary. In this respect, during maintenance work, the manhole does not have to be kept clear continuously and it is even conceivable to cover the manhole with the lifting mechanism during the activity of the maintenance personnel in the interior of the gas turbine. If, in an emergency, it is necessary to rescue the maintenance personnel, this can possibly be realized via a grating cover, which is held open with a drop bar for the emergency rescue. On the other hand, it may also be possible to rescue maintenance personnel via open burner openings in such an emergency.

According to a first particular embodiment of the crane system according to the invention, it is provided that the mating fastening section is designed as a mating flange which is screwed to the fastening section designed as a flange. Here, the flange is advantageously arranged in such a manner that it has a horizontal alignment when the gas turbine is used as intended. A deviation by a few degrees, up to about 4° to the horizontal, should still be regarded as horizontal within the scope of the present application. The flange is typically also referred to as a manhole flange. The flange connection between the fastening section and the mating fastening section is sufficiently stable with respect to force, so that even in the case of heavy loads to be lifted or supported by the lifting mechanism, sufficient safety can be guaranteed.

According to a further embodiment, it is provided that the manhole is arranged at a vertex of the outer housing. A vertex here relates to a point on the outer housing of the gas turbine, which represents the highest point in the radial circumferential direction (perpendicular to the direction of longitudinal extent of the gas turbine) during the intended use of the gas turbine. On account of this geometric arrangement, the lifting mechanism can be arranged over all regions of the outer housing of the gas turbine in a convenient manner, in order to perform maintenance work there. Furthermore, all outer regions of the gas turbine can largely be reached with equal ease. In a further embodiment, the manhole may also be provided in a region of the outer housing which, with respect to the vertex point, is arranged offset by up to 15° in the circumferential direction, perpendicular to the direction of longitudinal extent of the gas turbine. Here, this offset relates in particular to the center of gravity of the region, or generally to a point in this region, that is covered by the manhole.

According to a further embodiment of the invention, it is provided that the lifting mechanism is designed as a pillar crane, wherein in particular the mating fastening section is fitted to one end of a pillar of the pillar crane. It is very advantageous that the pillar crane also be adjustable in height. In the region of the attachment of the lifting mechanism to the gas turbine, a pillar crane has a relatively low space requirement, and so a particularly maintenance-friendly and space-saving lifting mechanism can be provided.

It is furthermore conceivable that the lifting mechanism has two boom arms or at least two boom arms which are in particular of pivotable design. The boom arms are in particular pivotable about a pivot axis perpendicular to the horizontal plane (foundation plane of the gas turbine) in the case of intended use. On account of the pivotability of the boom arms, the flexibility of use of the lifting mechanism can be increased. In order to guarantee the pivotability of the individual boom arms, suitable joints are provided for this purpose at predefined points of the boom arms.

According to a further concept, at least one of these boom arms is of multi-part design, wherein the individual parts are again pivotable with respect to one another. In other words, the individual parts are equipped with suitable pivot hinges or pivot joints, via which the individual parts of the boom arms are fastened to one another. A boom arm can thus have a plurality of pivot hinges or pivot joints, which again increase the flexibility of use of the boom arm in question.

According to a refinement of the embodiment with boom arms, it is provided that at least one of the boom arms is designed as a telescopic arm. It is equally conceivable that at least one part of the boom arm is of telescopic design. According to this embodiment, increased flexibility can be achieved when working with the crane system or the lifting mechanism. In particular, every desired maintenance region on the outer housing of the gas turbine can be reached, such that even fixing the lifting mechanism via the fastening section to the suitable mating fastening section of the outer housing of the gas turbine cannot present any limitation during the maintenance work, were this to be otherwise.

The invention will be described in more detail below on the basis of individual figures. Here, it should be pointed out that the components shown in the following figures which are provided with the same reference signs have the same technical effects.

It should furthermore be pointed out that the following figures are to be understood as being merely schematic and do not allow the derivation of any limitation with regard to practicability.

Furthermore, the components illustrated in the following figures are claimed in any combination with one another, wherever this combination can achieve the object upon which the invention is based.

DETAILED DESCRIPTION OF INVENTION

Figure 1:
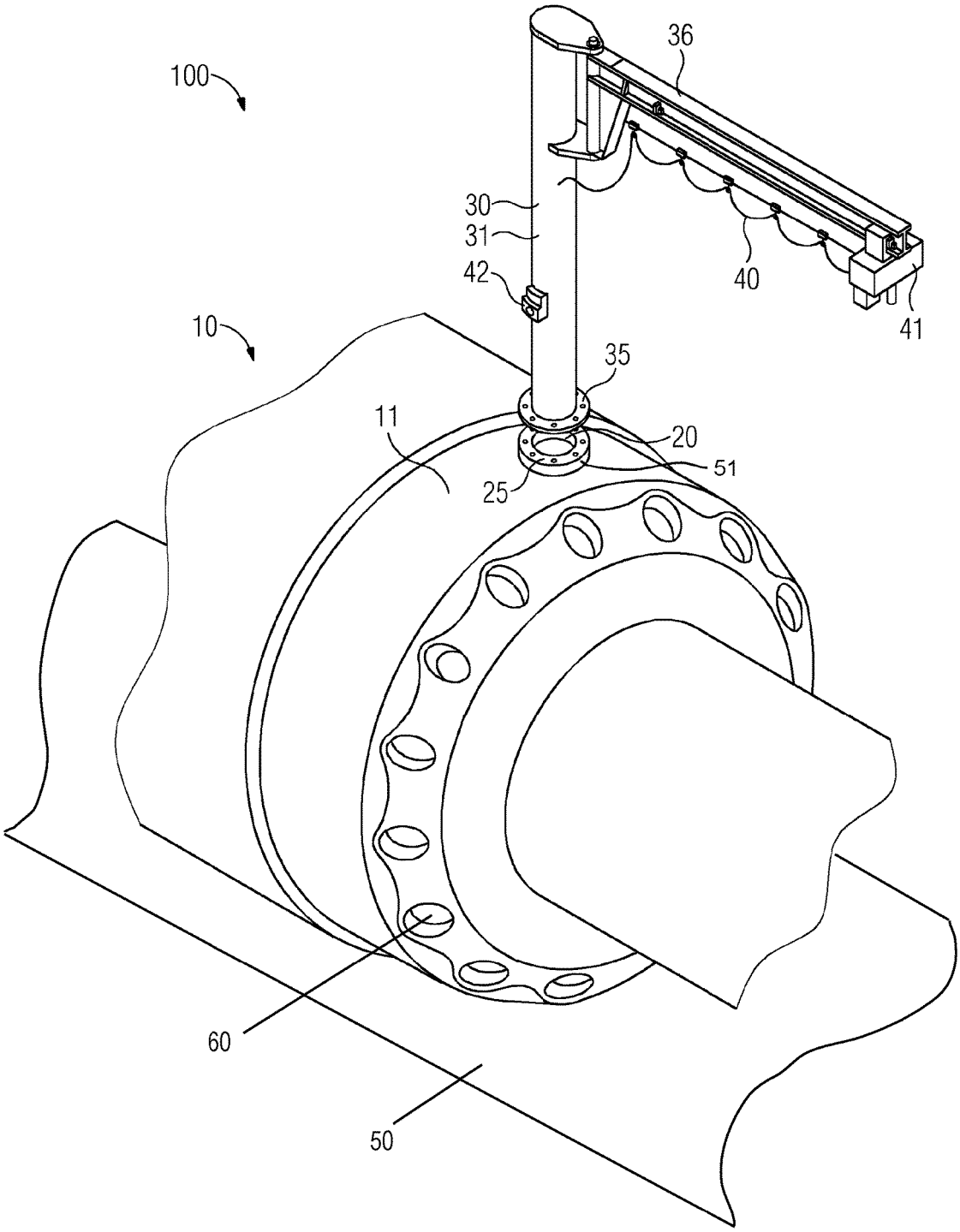
FIG. 1 shows a first embodiment of the crane system according to the invention with an embodiment of the lifting mechanism according to the invention in a perspective view from the side.

FIG. 1 shows a first embodiment of the crane system 100 according to the invention with an embodiment of the lifting mechanism 30 according to the invention, which mechanism is fitted to a fastening section 25 of a manhole 20 on the outer housing 11 of the gas turbine 10 on a foundation 50 via a mating fastening section 35. Besides the manhole 20, the outer housing 11 provides a further number of housing opening's 60 (burner openings), which are not provided with reference signs, via which the interior of the gas turbine 10 and thus the components acted upon by hot gas can be reached by the maintenance personnel.

The lifting mechanism 30 itself is designed as a pillar crane, which has a pillar 31 which has the mating fastening section 35 in question at one end, said mating fastening section being connected to the fastening section 25 of the manhole 20. The connection of the two sections 25, 35 is realized by means of a flange connection, since the fastening section 25 is designed as a fastening flange and the mating fastening section 35 is designed as a mating fastening flange. Both flanges are securely connected to one another, for example via suitable threaded bolts. The flange may have a thickened region 51.

The lifting mechanism 30 designed as a pillar crane further has a boom arm 36 which is connected at one end to the pillar 31 via a joint or pivot hinge (not further provided with a reference sign). The boom arm 36, which has a double-T profile or even an MSH profile in cross section (perpendicular to the direction of longitudinal extent), allows a motor 41 which is connected to an input unit 42 on the pillar 31 by a suitable electrical supply line 40, to perform lifting operations. For example, the motor 41 can be moved along the boom arm 36 via suitable running rollers (not provided with further reference signs), wherein, at the same time, a load cable (not shown in more detail) for lifting or supporting loads can be used, for example. By means of suitable handling, it is possible, for example, to move the boom arm 36 to a location, for example above the burner openings shown, such that, following suitable positioning of the motor along the boom arm 36, this arm can be directly positioned above the designated burner opening in an extended state. On account of the pillar structure, there is sufficient space available in the region of the burner openings for the maintenance personnel or a further maintenance device.

Figure 2:
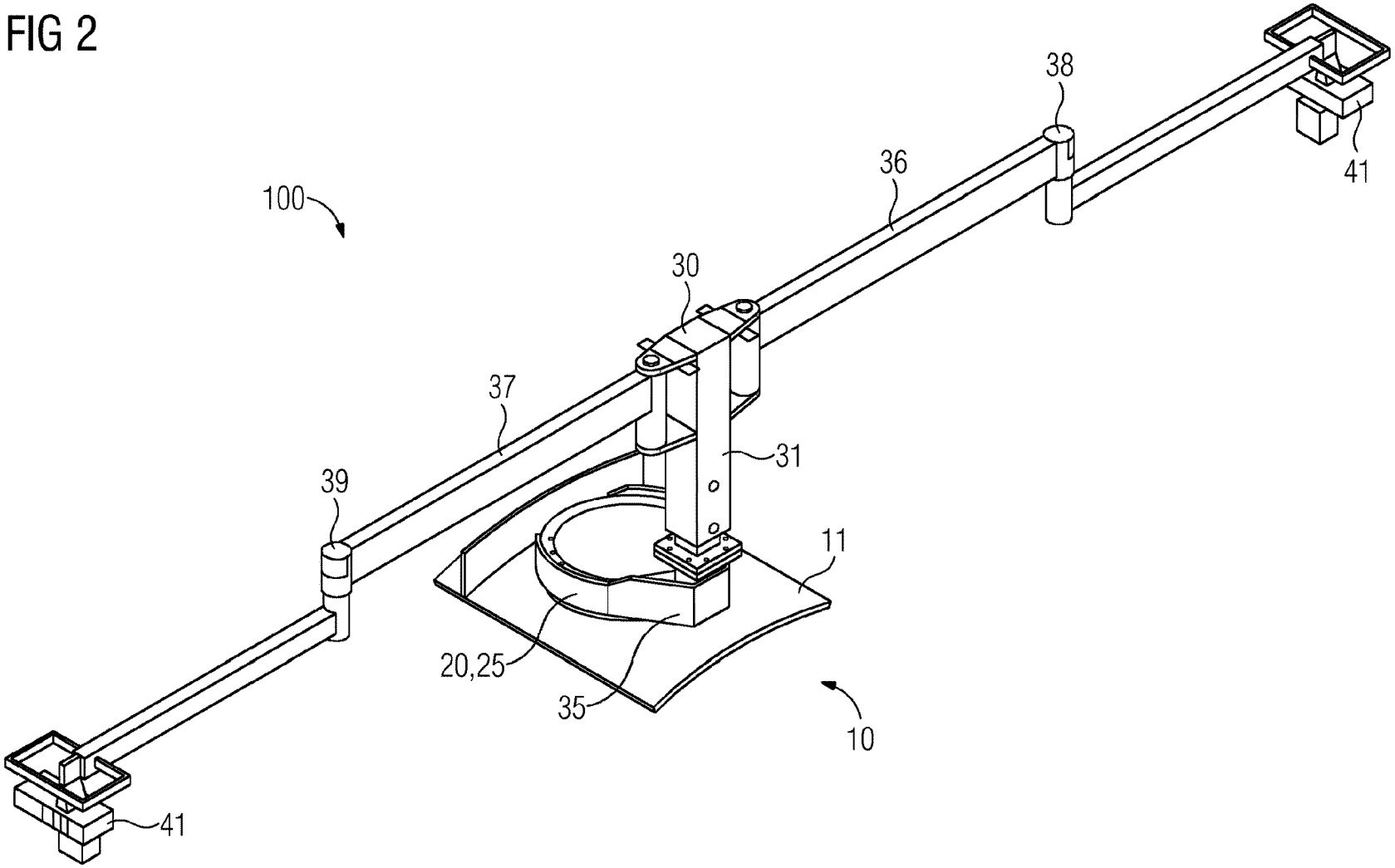
FIG. 2 shows a further embodiment of the crane system according to the invention with a further embodiment of the lifting mechanism according to the invention in a perspective side view.

FIG. 2 shows a further embodiment of the crane system according to the invention with another embodiment of the lifting mechanism 30 according to the invention. The lifting mechanism 30 has two boom arms 36, 37, which are both fastened to a pillar 31, in each case via a pivot joint (not further provided with a reference sign). The pivot joint allows pivoting of the boom arm 36, 37 in question through more than 180°, such that again all regions of the outer housing 11 of the gas turbine 10 required for maintenance can be reached by means of both boom arms 36, 37. At the same time, the lifting mechanism 30 provides two boom arms 36 and 37, which are also used at the same time. Consequently, the flexibility is increased when using the present embodiment. Alternatively, it is also possible for a plurality of boom arms 36, 37 to be provided for the purpose of further increasing the flexibilization of the use of the lifting mechanism 30.

The two boom arms 36, 37 are again of multi-part design, wherein the individual parts are again fastened in a pivotable manner with respect to one another. In order to pivot individual parts of a boom arm 36, 37 with respect to one another, joints 38 and 39 are provided in the respective boom arms 36 and 37. The joints 38 and 39 thus define the individual parts (not provided with reference signs) of the respective boom arm 36, 37.

The adjustment or pivoting of the boom arms 36, 37 can take place manually, with or without auxiliary means. Auxiliary means are, for example, suitable guide cables which are fitted to the boom arms 36, 37.

In order to further increase the flexibility with regard to the carrying out of maintenance work, the parts of the boom arms 36, 37 provided with the respective motors 41 can be of telescopic design. Likewise, it may also be sufficient for these end parts of the respective boom arms 36, 37 to have, in cross section, a double-T profile or an MSH profile, along which the respective motor 41 can be moved.

The fastening of the lifting mechanism 30 to the outer housing 11 of the gas turbine 10 is again realized by means of a suitable mating fastening section 35 which is fitted to the fastening section 25 of a manhole 20. In the present case too, the manhole 20 is arranged at a vertex of the outer housing 11 in a comparable manner to the embodiment shown in FIG. 1. This can be readily understood from the shown curvature of the outer housing 11.

Figure 3:
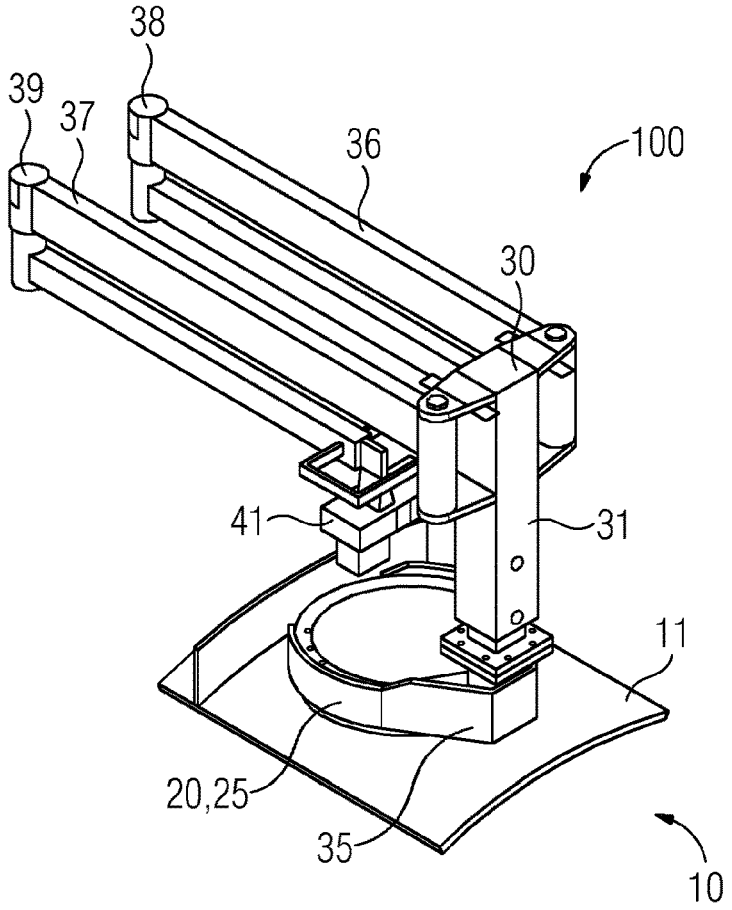
FIG. 3 shows the embodiment of the crane system according to the invention illustrated in FIG. 2 together with the embodiment of the lifting mechanism according to the invention in an operating position which differs from that in FIG. 2.

FIG. 3 shows the embodiment of the crane system 100 according to the invention already illustrated in FIG. 2 together with the corresponding embodiment of the lifting mechanism 30 according to the invention. The operating position illustrated in FIG. 3 differs from that illustrated in FIG. 2 solely in that the individual parts of the boom arms 36 and 37 have been pivoted via the joints 38 and 39 in such a manner that the parts belonging to one boom arm 36, 37 are largely oriented parallel to one another. On the basis of this illustration, it is readily apparent that not only regions of the outer housing 11 of the gas turbine 10 that are at a large distance from the manhole 20 can be reached by the boom arms 36, 37, but also maintenance regions that are situated in the immediate vicinity of the manhole. In addition, the operating state shown in FIG. 3 can also represent a standby position, in which the crane system 100 provides relatively little hindrance for other maintenance work that does not require the crane system 100. The present operating position can equally be a transport position in which the crane system 100 can be taken off the gas turbine 10 or mounted on it without hindering the installation work.

It should furthermore be pointed out that the pillar 31 of the lifting mechanism 30 is of height-adjustable design, such that the lifting mechanism 30 can, as a complete unit, also be adjusted in height.

Figure 4:
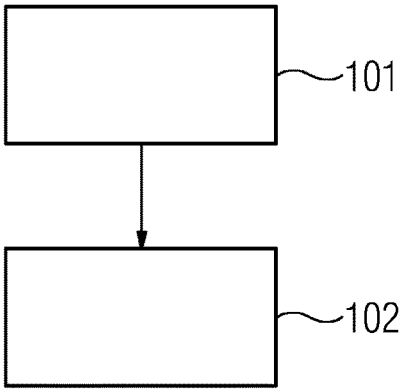
FIG. 4 shows a flow chart of a first embodiment of the method according to the invention for producing a crane system.

FIG. 4 shows a flow chart of an embodiment of the method according to the invention for producing a crane system. Here, the following steps are provided:—opening a manhole 20 on the outer housing 11 of a gas turbine 10 (first method step 101);—fastening a mating fastening section 35 of a lifting mechanism 30 to a fastening section 25 of the manhole 20 (second method step 102).

Further embodiments can be gathered from the subclaims.

The invention claimed is:

1. A crane system comprising:

a combustion gas turbine comprising
- an outer housing,
- a plurality of burner openings in the outer housing, and
- a manhole on the outer housing, the manhole comprising a fastening section; and a lifting mechanism comprising
- a mating fastening section,
- a pillar, and
- at least one boom arm, wherein the mating fastening section of the lifting mechanism is configured to be connected to the fastening section of the manhole, wherein, when the mating fastening section of the lifting mechanism is connected to the fastening section of the manhole, the lifting mechanism introduces weight forces onto the outer housing of the combustion gas turbine such that the weight forces are distributed onto the outer housing of the combustion gas turbine, and wherein, when the mating fastening section of the lifting mechanism is connected to the fastening section of the manhole, the at least one boom arm is positionable above the plurality of burner openings in the outer housing.

2. The crane system as claimed in claim 1, wherein the mating fastening section comprises a mating fastening section flange, and wherein the fastening section comprises a fastening section flange configured to be screwed to the mating fastening section flange.

3. The crane system of claim 2, wherein the fastening section flange has a thickened region via which the weight forces are further directed.

4. The crane system as claimed in claim 1, wherein the manhole is arranged at a vertex of the outer housing.

5. The crane system as claimed in claim 1, wherein the mating fastening section is fitted to one end of the pillar.

6. The crane system as claimed in claim 1, wherein the lifting mechanism comprises at least two boom arms which comprise a pivotable design.

7. The crane system as claimed in claim 6, wherein at least one boom arm of the at least two boom arms comprises a multi-part design comprising individual parts, wherein the individual parts are pivotable with respect to one another.

8. The crane system of claim 1, further comprising:

the pillar secured to the mating fastening section, and the boom arm pivotably secured to the pillar.

9. The crane system of claim 8, wherein the boom arm comprises two boom parts pivotally secured to each other so that the two boom parts pivot about a vertical pivot axis.

10. The crane system of claim 1, wherein the fastening section located on the outer housing is adapted to support loads to be lifted and is adapted to provide an introduction of force into a foundation upon which the combustion gas turbine is already positioned, wherein the foundation is designed for loading with large weight forces.

11. The crane system of claim 1, wherein the at least one boom arm is pivotable on the pillar such that the at least one boom arm is positionable above the plurality of burner openings in the outer housing.

* * * * *